United States Patent [19]

Boers et al.

[11] Patent Number: 4,937,985

[45] Date of Patent: Jul. 3, 1990

[54] ABRASIVE WATERJET RECEIVER

[75] Inventors: Arie Boers, Plymouth; Mark R. Frich, Maplewood, both of Minn.

[73] Assignee: Possis Corporation, Minneapolis, Minn.

[21] Appl. No.: 412,116

[22] Filed: Sep. 25, 1989

[51] Int. Cl.[5] ..... B24C 9/00; B24C 3/00

[52] U.S. Cl. ..... 51/410; 51/424; 51/321; 83/53; 83/177

[58] Field of Search ..... 51/410, 424, 425, 439, 51/319, 320, 321; 83/177, 53; 134/104.4

[56] References Cited

U.S. PATENT DOCUMENTS

| | | | |
|---|---|---|---|
| 4,116,097 | 9/1978 | Graham et al. | 83/177 X |
| 4,532,949 | 8/1985 | Frank | 83/53 X |
| 4,665,949 | 5/1987 | Jordan | 83/53 X |
| 4,669,229 | 6/1987 | Ehlbeck | 51/410 |
| 4,698,939 | 10/1987 | Hashish | 51/410 |
| 4,799,415 | 1/1989 | Gerdes | 83/53 X |
| 4,872,293 | 10/1989 | Yasukawa | 51/424 X |

*Primary Examiner*—Frederick R. Schmidt
*Assistant Examiner*—Bruce P. Watson
*Attorney, Agent, or Firm*—Burd, Bartz & Gutenkauf

[57] ABSTRACT

An abrasive liquid jet cutting system has a cutting head for directing a jet of ultra high pressure water and grit to a work piece. The jet cuts the work piece in a desired pattern to form a product. The liquid from the jet, grit, and particulate materials of the work piece are collected with a receiver located generally below the cutting head. Controls for both the cutting head and receiver are coordinated to move the receiver along with the cutting head so that the water and particulate materials are collected by receiver. The receiver has an upright tubular member provided with wear resistant sleeves and an upright central rod to absorb the impact forces of the water and particulate materials that move through the receiver. A drive means connected to the tubular body operates to continuously rotate the tubular body, sleeves and rod to distribute the wear around the sleeves and rod caused by the water, grit and particulate materials that impinge thereon.

42 Claims, 3 Drawing Sheets

ABRASIVE WATERJET RECEIVER

FIELD OF THE INVENTION

The invention concerns waterjet cutting systems and more specifically an apparatus and method for collecting water and particulate materials cut from the work piece with a waterjet containing abrasive materials or grit.

BACKGROUND OF THE INVENTION

High pressure small diameter liquid jets containing abrasive materials are used to cut materials, such as metals, ceramics, and concrete. Machines, known as waterjet cutting machines, having cutting heads connected to high pressure water pumping systems to establish ultra-high pressure water jets. The cutting heads are moved relative to work pieces to produce desired cuts and shapes in the work pieces. The waterjets along with the particulate materials of the work pieces are collected below the work pieces for appropriate disposal. Tank structures containing liquids and solid cylindrical elements have been used below the cutting heads and work pieces to provide a sink or reservoir for the water, abrasive materials or grit that may be used with the water, and the cut particulate materials of the work piece. The abrasive materials moving with the waterjet cause considerable wear and erosion on the collecting structures. The fast moving waterjet cutting the work piece and flowing into the collecting structure generates considerable noise.

SUMMARY OF THE INVENTION

The invention relates to a liquid jet cutting system for cutting a work piece having a catcher or receiver for collecting the liquid of the jet, abrasive materials incorporated in the jet, and the particulate materials of the work piece. The receiver can be used to collect liquid from a jet that does not contain abrasive materials. The receiver has a member with a passage extended between an open inlet end for receiving liquid and particulate materials from the cutting head and work piece and an open outlet end remote from inlet end for carrying the liquid and particulate materials from the passage to a desired location. The member is operatively connected to a drive apparatus for rotating the member during the time that the liquid and particulate materials flow through the passage to reduce wear and erosion on the parts of the member. The member along with its passge and relatively small open inlet end attenuates the noise of the jet cutting operation. The member is moved with a control that follows the movement of the jet cutting head so that the receiver follows the cutting head to gather the liquid and particulate materials emanating from the cutting head and work piece. A vacuum generator is connected to the receiver to provide a continuous flow of air through the receiver whereby the liquid and particulate materials are drawn into the passage of the receiver and discharged into a solid-liquid separator for appropriate disposal.

The preferred embodiment of the receiver for an abrasive waterjet has a generally upright tubular body having a generally cylindrical inside wall. A plurality of carbide sleeves are located within the tubular body adjacent the inside wall providing a passage for the water and particulate materials through the body. A cap mounted on the upper end of the body has a carbide tube with an inlet opening in communication with the passage to allow water and particulate materials to flow from the work piece into the passage. An upright rod is located within the passage in general alignment with the inlet opening. The water and particulate materials moving through the inlet opening impinge upon the rod and the sleeves as they flow through the passage. The tubular body is mounted on a base that is rotatably mounted on a support. A motor driven power transmission is operable to rotate the base about the longitudinal axis of the rod whereby the body, sleeves and rod are rotated to distribute the wear and abrasion forces impacted thereon by the rapidly moving water and particulate materials of the jet. A plurality of disks located in the passage support the rod along the longitudinal axis of the passage. The disks have holes to allow the water and particulate materials to flow through the passage. The disks function as support for the upright rod and muffle the sound of the rapidly moving air and water flowing through the passage. A control is connected to the receiver to move the receiver concurrently with the movement of the cutting head so that the open upper end of the receiver follows the waterjet as it cuts the work piece. A vacuum generator is connected to the base to draw air, water, and particulate materials through the passage and discharge the liquid and particulate materials to a selected location, such as a liquid-solid seperator. The passage surrounded the sleeves with he small inlet opening of the tube on the cap and the vacuum within the passage attenuates noise of the waterjet and air flowing through the receiver.

The invention includes a method of collecting water and grit from an abrasive waterjet along with particulate materials from a work piece cut with the abrasive waterjet in a manner that reduces wear and erosion of the receiver of these materials and reduces noise created by the abrasive waterjet. This method locates the receiver adjacent to the work piece and abrasive waterjet in a position to permit water, grit, and work piece particulate materials to flow into and through the receiver. The receiver is continuously rotated about an axis generally along the direction of flow of the materials through the passage to mitigate wear and erosion of the structure of the receiver. The receiver is moved along with the abrasive waterjet to continuously collect water, grit, and work piece particulate materials. A vacuum force applied to the passage of the receiver draws air, water, grit and work piece particulate materials through the passage. The vacuum in passage prevents an air pressure build up in the passage and aids in attenuation of noise.

DESCRIPTION OF PREFERRED EMBODIMENT

Figure 1:
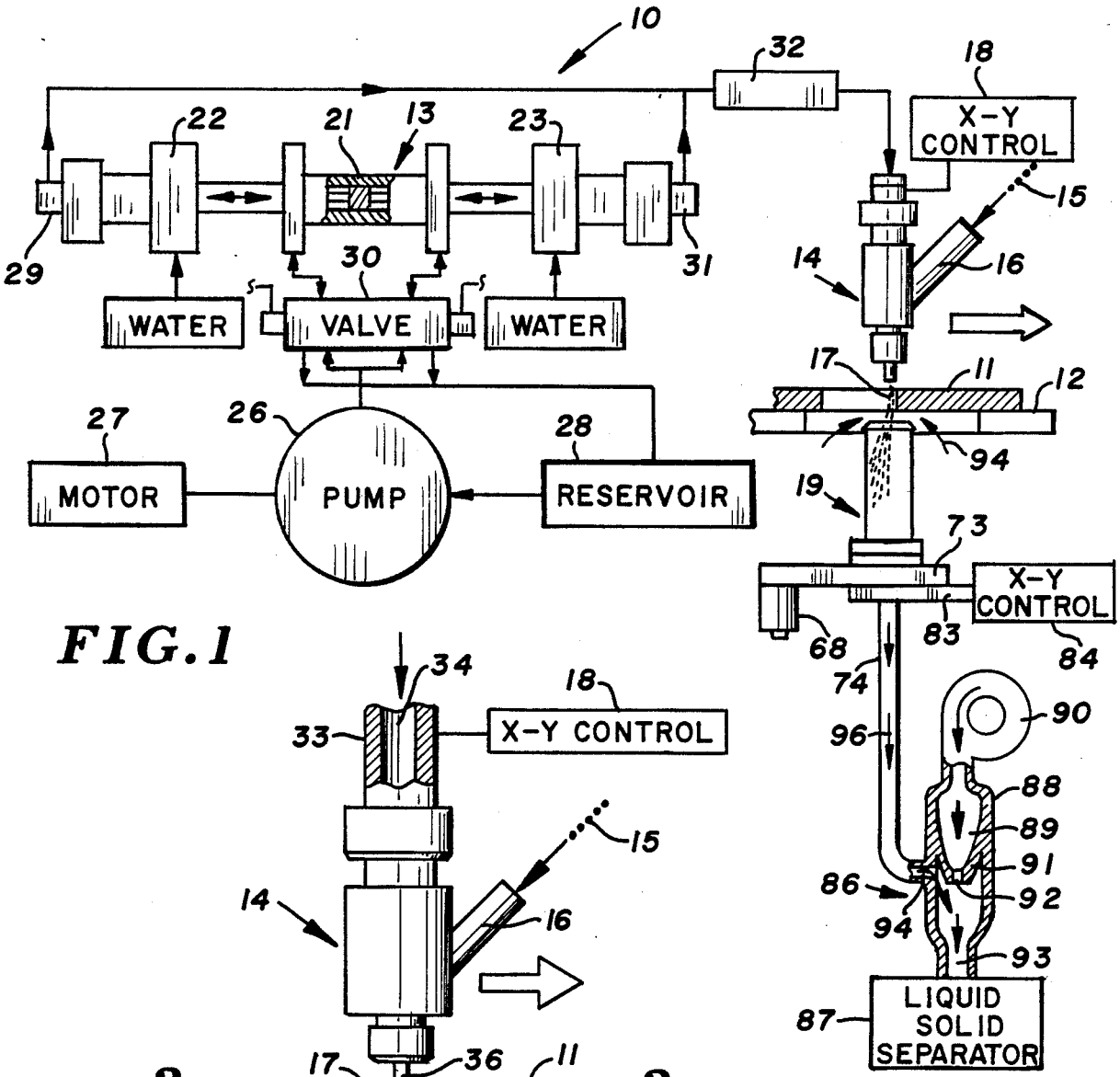
FIG. 1, is a diagrammatic view of an abrasive liquid jet cutting system having the liquid, grit, and particulate material receiver of the invention.

Referring to FIG. 1, there is shown an abrasive liquid jet cutting system indicated generally at 10 for cutting a work piece 11 mounted on a table 12. The liquid jet cutting system described herein is a waterjet cutting machine having a waterjet containing grit or abrasive materials. The catcher or receiver of the invention can be used with a liquid jet cutting system that has a high velocity liquid jet that does not include abrasive materials. Work piece 11 is a generally flat plate of ridged and/or semi-ridged material, as plastic, metal, ceramic, concrete, composite materials and the like. Work table 12 is a generally rectangular frame that horizontally supports work piece 11 above a floor of the work place. The work piece can be held in special fixtures (not shown). The liquid is water. Other types of liquids and mixture of liquids can be used to form the cutting jet.

Abrasive liquid jet cutting system 10 has an intensifier, indicated generally at 13, operable to provide a continuous supply of water under ultra high pressure to a cutting head indicated generally at 14. Ultra high pressure water is under pressure of at least 30,000 psi. The water pressure developed by intensifier 13 is in the range of 30,000 to over 100,000 psi. Cutting head 14 accommodates a supply of grit or abrasive materials introduced to cutting head 14 through a side tube 16. A continuous supply of grit is directed into tube 16 from a grit source (not shown). The grit is entrained within the high velocity jet 17 of water that is discharged through an elongated tubular nozzle 36 at the lower end of cutting head 14. Nozzle 36 projects downward toward the top of work piece 11.

An X-Y control 18 programed by a computer (not shown) controls the movement of cutting head 14 relative to work piece 11 to provide a selected cut in work piece 11 to make a product. The cut has relatively narrow kerf which allows complex parts to be made with cutting head 14.

Figure 2:
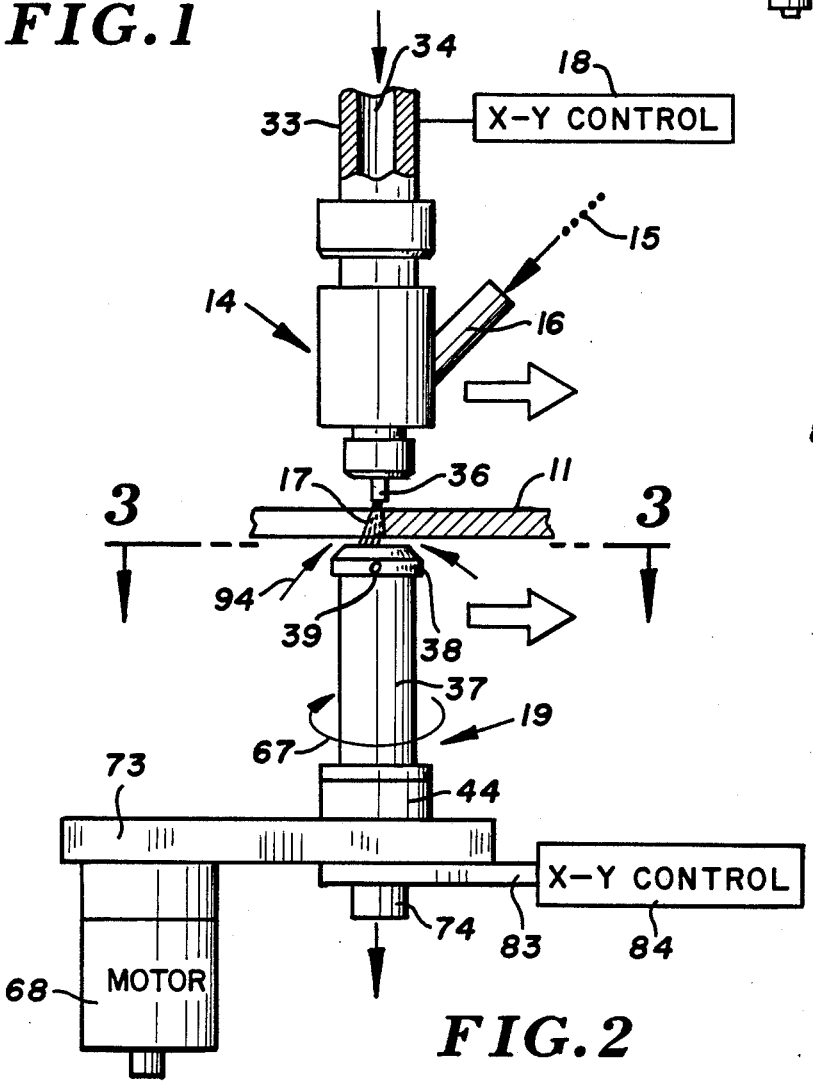
FIG. 2 is an enlarged side elevational view, partly sectioned, of the abrasive waterjet cutting head, work piece, and catcher of the abrasive waterjet cutting system of FIG. 1.

As shown in FIGS. 1 and 2, a high velocity liquid jet 17 containing the abrasive material cuts through work piece 11. The water, abrasive material, and particulate materials of work piece 11 are directed downwardly into a catcher or receiver indicated generally at 19. Receiver 19 collects the water, grit, and particulate materials of work piece 11 and discharges these materials into a liquid-solid separator 87 which gathers the particulate material and separates them from the water for appropriate disposition compatible with the environment. A vacuum generator 86 draws air, water, grit, and particulate materials through receiver 19 and discharges these materials into liquid-solid separator 87. The detailed structure of receiver 19 is herein after described.

Intensifier 13 has a piston and cylinder assembly, referred to as a hydraulic motor 21, that sequentially operates piston pumps 22 and 23 to elevate the pressure of the water to the ultra high pressure range. Motor 21 is operated in response to hydraulic fluid under pressure derived from a pump 26 driven by a motor 27. The hydraulic fluid is withdrawn by operation of pump 26 from a reservoir 28 and discharged into a solenoid operated reversing valve 30 operable to selectively supply hydraulic fluid under pressure to opposite ends of motor 21 and return fluid back to reservoir 28. The ultra high pressure of water flows from pumps 22 and 23 through check valves 29 and 31 into an attenuator 32 which provides for a constant flow rate of water to cutting head 14. The ultra high pressure water is delivered to a linear chamber 34 of a generally upright body 33 of cutting head 14. The water flows through a small opening in a sapphire, ruby, diamond or corundum element located adjacent the upper end of nozzle 36. Grit 15 is introduced into the stream of water flowing between the sapphire element and the upper end of nozzle 36. A mixture of grit and water flows through nozzle 36 and is discharged therefrom as a high velocity small diameter waterjet 17.

Figure 3:
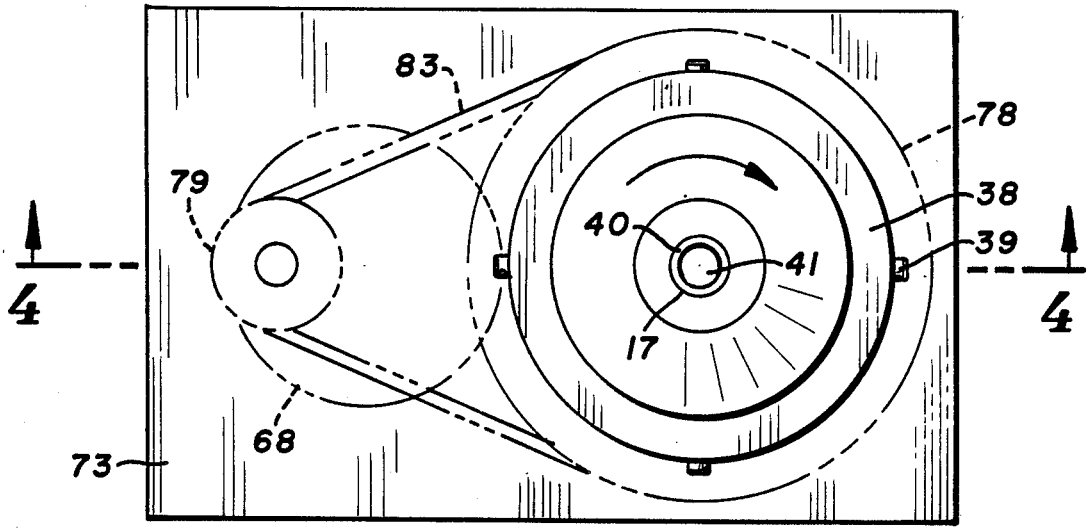
FIG. 3 is an enlarged sectional view taken along line 3—3 of FIG. 2.
Figure 5:
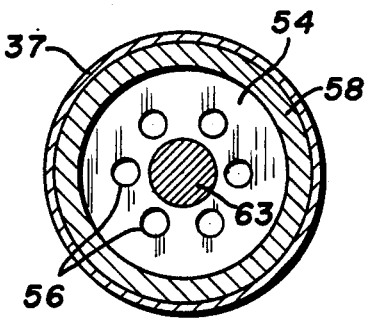
FIG. 5 is a sectional view taken along line 5—5 of FIG. 4.
Figure 4:
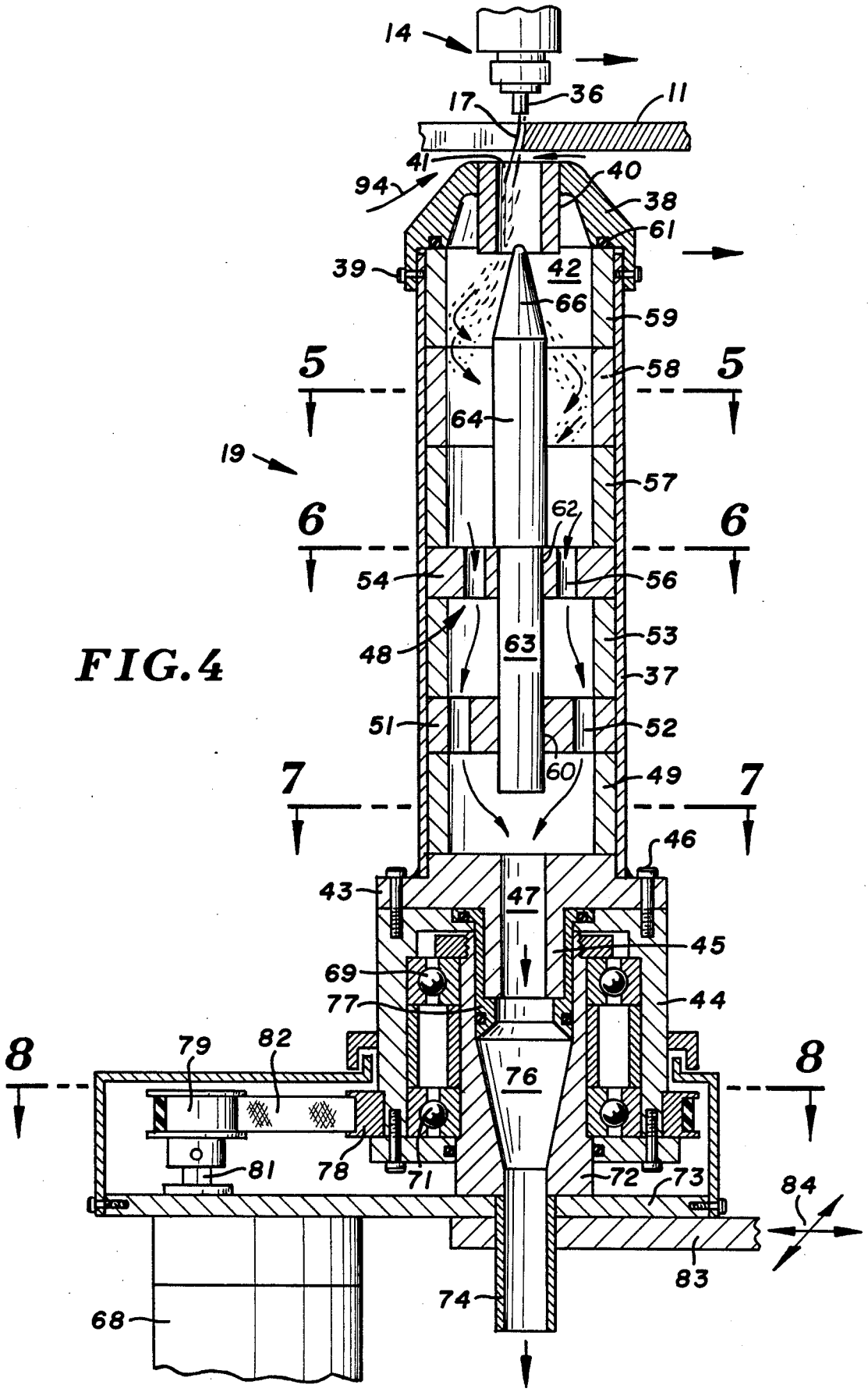
FIG. 4 is a sectional view taken along line 4—4 of FIG. 3.

As shown in FIGS. 2, 3 and 4, receiver 19 has an upright tubular body 37 supporting a top member or cap 38. A plurality of fasteners 39, such as bolts, secure cap 39 to body 37. The top of cap 38 has a short upright tube 40 of wear resistant material, such as carbide. Tube 40 has an opening 41 providing access to an elongated cylindrical chamber or passage 42. The cross sectional area of opening 41 is smaller than the cross sectional area of passage 42. The bottom of body 37 is supported on a base 43. Base 43 is attached to a generally cylindrical sleeve or collar 44 with a plurality of bolts 46. Base 43 has an upright passage 47 aligned with passage 42.

Figure 6:
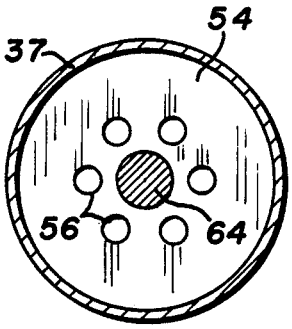
FIG. 6 is a sectional view taken along line 6—6 of FIG. 4.
Figure 7:
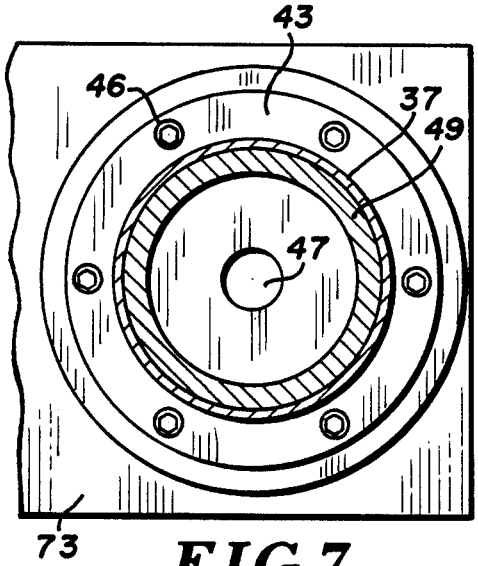
FIG. 7 is a sectional view taken along line 7—7 of FIG. 4.
Figure 8:
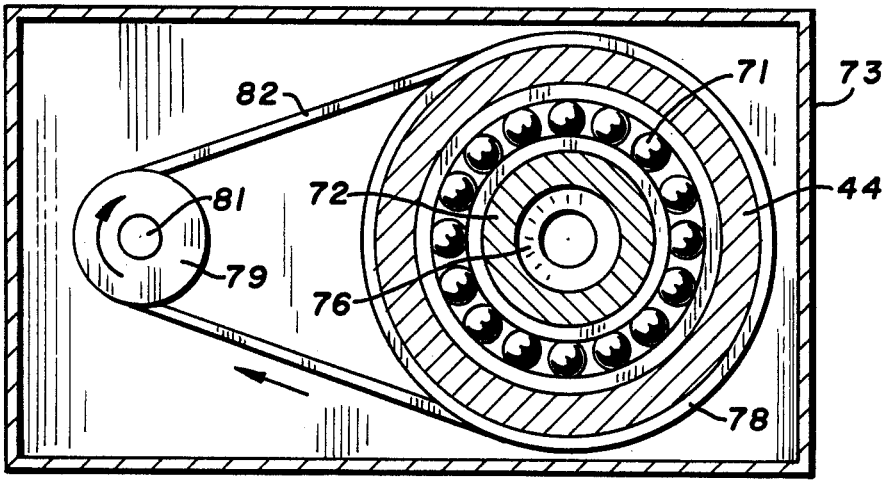
FIG. 8 is a sectional view taken along line 8—8 of FIG. 4.

A wear resistant liner assembly indicated generally at 48 is located within tubular body 37 to eliminate wear and erosion of tubular body 37. Liner assembly 48 has a first tubular element or sleeve 49 mounted on a base 46. A disc spacer 51 separates sleeve 49 from a second sleeve 53. Spacer 51 has a plurality of circumferentially spaced holes 52 providing passages for the flow of liquid and materials from sleeve 53 to sleeve 49. A second spacer 54 having a plurality of holes 56, as shown in FIG. 6, rests on top of sleeve 53. A plurality of end-to-end sleeves 57, 58, and 59 extend upwardly from spacer 54 to cap 38 and form pasage 42. An annular seal O-ring 61 under compression holds sleeves 49, 53, 57, 58, 59 and spacers 51 and 54 in tight assembled relation within tubular body 37.

Spacers 51 and 54 have central holes 61 and 62 accommodating a lower cylindrical end 63 if an upwardly projected rod 64. End 63 is located in tight or press fit relation in holes 61 and 62. The upper end of rod 64 has a generally upwardly directed cone 66 terminating in an end that is generally parallel to the horizontal plane of the top of upper sleeve 59 and lower end of tube 40. Rod 64 is located along the upright longitudinal axis of tubular body 37 and is concentric with opening 41 in tube 40. The diameter of rod 64 is larger than the diameter of opening 41. The diameter of rod 64 can be the same as or smaller than the diameter of opening 41. Rod 64 is spaced inwardly from the inner cylindrical surfaces of sleeves 53, 57, 58 and 59 and provides an annular passage for the flow of water, grit and the particulate materials of work piece 11, as shown by the arrows in FIG. 4. The water, grit, and particulate materials moving through opening 41 impinge or strike the cone shaped upper end 66 of rod 64 and bounce outwardly toward upper sleeves 58 and 59. Some of the water, grit, and particulate materials flow past rod 64 and impinge on sleeves 57, 58 and 59 as they flow through passage 42. Sleeves 53, 57, 58, and 59, spacers 51 and 54, and rod 64 are made of an abrasive resistant material, such as carbide.

Tubular body 37 along with sleeves 49, 53, 57, 58, and 59 and spacers 52 and 54 are continuously rotated, as indicated by arrow 67 in FIG. 2, with the operation of a gear head electric motor 68. A pair of bearings 69 and 71 rotatably mount collar 44 on an upright post 72. Post 72 is mounted on a housing 73 that supports a gear head motor 68. Housing 72 supports a downwardly directed outlet tube 74 aligned with a passage 76 in post 72. The upper end of passage 76 is in vertical alignment with passage 47 in base 43. Base 43 has a downwardly direct tubular projection or boss 45 that fits within a sleeve bearing 77 mounted on base 43 with a collar 44.

A belt and pully drive connects gear head motor 68 to the lower end of collar 44. A pulley 78 is mounted on the lower end of collar 44 in horizontal alignment with a drive pulley 79 mounted on the upper end of a drive shaft 81 connected to gear head motor 68. An endless belt 82 trained about pulleys 78 and 79 operates to continuously rotate collar 44 along with tubular member 37 and cap 38 about the upright longitudinal axis of receiver 19. Other types of drive systems can be used to rotate receiver 19.

Housing 73 is mounted on a control arm 83 operable to move receiver 19 to follow cutting head 14 so as to collect the water, grit, and work piece particulates in chamber 42 of receiver 19. Arm 83 is connected to an X-Y control 84 that is subject to the commands of the computer than programs X-Y controls 18 and 84.

As shown in FIG. 1, a vacuum pump or generator, indicated generally at 86, is connected to receiver outlet 74 to continually draw air through passage 42 of receiver 19. The moving air picks up water, grit, and particulate materials adjacent cap 38 and directs jet 17 into passage 41 of tube 40. Air moving through passage 42 transports the water, grit, and particulate materials to a liquid-solid separator 87. Separator 87 removes the grit and particulate materials from the water so that they can be disposed of in an environmentally compatible manner.

Vacuum generator 86 also prevents a build up of air pressure in passage 42 which inhibits the collection of water, grit, and particulates by receiver 19. Vacuum generator 86 has a tubular body 88 having a passage 89. A blower 90 operates to direct air under pressure into passage 89. A cone-shaped wall 91 positioned across passage 89 has a small opening or throat 92 that directs a high velocity stream of air to an outlet passage 93 leading to liquid-solid separator 87. The side of body 88 adjacent wall 91 has an opening 94 open to passage 89 and in communication with receiver outlet 74 via hose or pipe 96. The high velocity stream of air flowing through throat 92 creates a vacuum at opening 94 and downstream of cone-shaped wall 91. The vacuum draws air, water, grit, and particulate materials through passage 42 of receiver 19 and discharges the air, water, and solids into liquid-solid separator 87. In use of the method of operation of the abrasive waterjet cutting system is as follows. A continuous supply of ultra high pressure water from intensifier 13 is directed to cutting head 14. A high velocity small stream or jet of water flowing through cutting head picks up grit in the cutting head and is discharged as an abrasive waterjet 17 through nozzle 36 toward work piece 11. The high velocity abrasive waterjet 17 cuts work piece 11 along a selected pattern to make a product. The water, grit, and particulate materials from the work piece 11 flow downwardly or below the work piece into receiver 19. Gear head motor 68 is operated to continuously rotate body 37 with tube 40, liner assembly 48 and rod 64 of receiver 19. The X-Y controls 18 and 84 operate in response to computer commands simultaneously move cutting head 14 and receiver 19 to cut work piece 11 according to the desired shape and collect water, grit, and work piece particulate materials. Jet 17 along with the grit and particulate materials from work piece 11 is directed through inlet opening 41 into the elongated chamber 42. These materials, as shown by the arrows in FIG. 4, strike the upper end 66 of rod 64 and inner wall of sleeves 57–59 as they are rotated. The materials flow through holes 56 and 52 in spacers 54 and 51 and out through outlet passages 47 and 76 to a disposal location. A vacuum force is applied to outlet tube 74 with vacuum generator 86 to facilitate the movement of all the materials along with air through receiver 19. The rotating sleeves 57, 58, and 59 and rod 64 being carbide members, reduce erosion and abrasion due to the water, grit, and particulate materials flowing through passage 42. The continuous rotation of tube 40, sleeves 57, 58 and 59 and rod 64 distributes the wear and abrasion forces on tube 40, sleeves 57–59, and rod 64 and minimize concentrated cutting and erosion of the material of the tube, sleeves, and rod. Holes 56 and 52 in spacers 54 and 51 reduce the velocity of the liquid and particulate materials as they flow through catcher 19. Receiver 19 also acts as a muffler to dampen the noise created by the waterjet 17 emanating from cutting head 14. The diameter of inlet opening 41 being smaller than the cross sectional area of passage 42 along with the mass of the sleeves 57–59 surrounding passage 42 and the vacuum in passage 42 attenuates noise of the waterjet and air flowing through passage 42 of receiver 19. Receiver 19 eliminates relatively large collection tanks and clean up procedures used with prior liquid jet cutting systems.

While there have been shown and described a preferred embodiment of the receiver for the abrasive waterjet cutting system and method of collecting water, grit, and particulate materials of the invention is understood that changes in the structures, materials, arrangement of structures and methods and use of the receiver can be made by those skilled in the art without departing from the invention. The invention is defined in the following claims.

We claim:

1. A receiver for collecting liquid and particulate materials emanating from a moving jet cutting head and a work piece of liquid jet cutting machine comprising: first means having a passage with a longitudinal axis, an open inlet end for receiving liquid and particulate materials from the cutting head and work piece, and an open outlet end remote from the inlet end for carrying liquid and particulate materials from the passage to a desired location, and second means operatively connected to the first means for rotating the first means about the longitudinal axis thereof as the liquid and particulate materials flow through said passage.

2. The receiver of claim 1 wherein: the first means includes a tubular body having an inside wall and sleeve means located within said body adjacent the inside wall thereof, said sleeve means providing said passage accommodating the liquid and particulate materials.

3. The receiver of claim 2 wherein: the first means includes a rod within said passage spaced from and surrounded by the sleeve means.

4. The receiver of claim 1 wherein: the first means includes a tubular body having an upper end, a lower end, and an inside wall extended between the upper and lower ends, sleeve means adjacent said inside wall providing the passage for liquid and particulate materials through the tubular body, cap means mounted on the upper end of the body, said cap means having an inlet opening open to said passage to allow liquid and particulate materials to flow into said passage, a base having an outlet passage open to the passage of the sleeve means secured to the lower end of the tubular body, means mounting the base for rotation about the longitudinal axis of the passage, said second means cooperating with said base to rotate the tubular body, sleeve means, and base about the longitudinal axis of the passage.

5. The receiver of claim 4 wherein: said cap means includes a tube surrounding said open inlet end, and an upright rod means located below said tube whereby liquid and particulate materials flow through said open inlet end impinge on said rod means and sleeve means as they move through said passage.

6. The receiver of claim 4 wherein: said cap means engages the sleeve means to retain the sleeve means in said tubular body.

7. The receiver of claim 4 wherein: said sleeve means comprises a plurality of cylindrical tubular members positioned end-to-end within said tubular body.

8. The receiver of claim 1 wherein: the first means has a tube surrounding the inlet end open to the passage and a rod located in said passage below the tube whereby liquid and particulate materials impinge on said rod as they move through the passage to the open outlet end.

9. The receiver of claim 1 wherein: the first means includes sleeve means providing said passage, upright rod longitudinally located in said passage below said open inlet end, and means mounting the rod on said sleeve means.

10. The receiver of claim 9 including: an upright tube surrounding said open inlet end, said tube located above said rod.

11. The receiver of claim 9 wherein: the means mounting the rod on the sleeve means includes disk means associated with the sleeve means, said disk means having first hole means accommodating a portion of the rod to hold the rod and second hold means to allow fluid and particulate materials to flow through the passage to the open outlet end.

12. The receiver of claim 11 wherein: the disk means includes a plurality of spaced disks having aligned first holes accommodating said portion of the rod and second holes allowing fluid and particulate materials to flow through the disks.

13. The receiver of claim 1 wherein: the first means includes a tubular body and sleeve means located within the body, said sleeve means comprise a plurality of cylindrical sleeves positioned end-to-end within said tubular body.

14. The receiver of claim 1 including: a support, means rotatably mounting the first means on the support for rotation about the longitudinal axis of the passage, and control means connected to the support operable to move the first means concurrently with movement of the cutting head.

15. The receiver of claim 1 wherein: the second means to rotate the first means includes a motor and drive means connecting the motor to the first means whereby on operation of the motor the first means is rotated about the longitudinal axis of the passage.

16. The receiver of claim 1 combined with vacuum generator means connected to the first means to draw air, liquid, and particulate materials through said passage and discharge the liquid and particulate materials to a selected location.

17. The receiver of claim 16 including: control means connected to the first means operable to move the first means concurrently with the movement of the cutting head.

18. An apparatus for cutting a work piece with a liquid jet cutting machine having means for pressurizing a liquid comprising: cutting head means having liquid discharge nozzle means connected to the means for pressurizing a liquid for directing a liquid jet toward a work piece for cutting the work piece, first control means connected to the cutting head means to control the movement of the cutting head means in desired directions, receiver means having a passage located below said work piece in general vertical alignment with the nozzle means for collecting liquid and particulate materials emanating from the nozzle means and the work piece, and discharging the liquid and particulate materials therefrom, second control means connected to the receiver means to control the movement of the receiver means according to the movements of the cutting head means, said receiver means including first means having a passage with a longitudinal axis, an open inlet end for receiving liquid and particulate materials from the nozzle means and work piece, and an open outlet end remote from the inlet end for carrying liquid and particulate materials away from the receiver means, and second means operatively connected to the first means for rotating the first means about the longitudinal axis thereof as the liquid and particulate materials flow through said passage.

19. The apparatus of claim 18 wherein: the first means includes a tubular body having an inside wall and sleeve means located within said body adjacent the inside wall thereof, said sleeve means providing said passage accommodating the liquid and particulate materials.

20. The apparatus of claim 19 wherein: the first means includes a rod within said passage spaced from and surrounded by the sleeve means.

21. The apparatus of claim 18 wherein: the first means includes a tubular body having an upper end, a lower end, and an inside wall extended between the upper and lower ends, sleeve means adjacent said inside wall providing the passage for liquid and particulate materials through the tubular body, cap means mounted on the upper end of the body, said cap means having an inlet opening open to said passage to allow liquid and particulate materials to flow into said passage, a base having an outlet passage open to the passage of the sleeve means secured to the lower end of the tubular body, means mounting the base for rotation about the longitudinal axis of the passage, said second means cooperating with said base to rotate the tubular body, sleeve means, and base about the longitudinal axis of the passage.

22. The apparatus of claim 21 wherein: the cap means includes a tube surrounding said open inlet end, and an upright rod means located below said tube whereby liquid and particulate materials flow through said open inlet end impinge on said rod means and sleeve means as they move through said passage.

23. The apparatus of claim 21 wherein: said cap means engages the sleeve means to retain the sleeve means in said tubular body.

24. The apparatus of claim 21 wherein: said sleeve means comprises a plurality of cylindrical tubular members positioned end-to-end within said tubular body.

25. The apparatus of claim 18 wherein: the first means has a tube surrounding the open inlet end open to the passage and a rod located in said passage below the sleeve whereby liquid and particulate materials impinge on said rod as they move through the passage to the open outlet end.

26. The apparatus of claim 18 wherein: the first means includes sleeve means providing said passage, upright rod longitudinally located in said passage below the inlet opening, and means mounting the rod on said sleeve means.

27. The apparatus of claim 26 wherein: the means mounting the rod on the sleeve means includes disk means associated with the sleeve means, said disk means having first hole means accommodating a portion of the rod to hold the rod and second hold means to allow fluid and particulate materials to flow through the passage to the open outlet end.

28. The apparatus of claim 27 wherein: the disk means includes a plurality of spaced disks having aligned first holes accommodating said portion of the rod and second holes allowing fluid and particulate materials to flow through the disks.

29. The apparatus of claim 18 wherein: the first means includes a tubular body and sleeve means located within the body, said sleeve means comprise a plurality of cylindrical sleeves positioned end-to-end within said tubular body.

30. The apparatus of claim 18 wherein: the second means to rotate the first means includes a motor and drive means connecting the motor to the first means whereby on operation of the motor the first means is rotated about the longitudinal axis of the passage.

31. The apparatus of claim 18 combined with vacuum generator means connected to the first means to draw air, liquid, and particulate materials through said passage and discharge the liquid and particulate materials to a selected location.

32. An apparatus for cutting a work piece with a liquid jet cutting machine having means for pressurizing a liquid comprising: cutting head means having liquid discharge nozzle means connected to the means for pressurizing a liquid for directing a liquid jet toward the work piece for cutting the work piece, first control means connected to the cutting head means to control the movement of the cutting head means in desired directions, receiver means having means with a passage located below said work piece in general vertical alignment with the nozzle means for collecting liquid and particulate materials eminating from the nozzle means and the work piece and discharging the liquid in particulate materials therefrom, and drive means for rotating the means with a passage, second control means connected to the receiver means to control the movement of the receiver means according to the movements of the cutting head means, and vacuum generator means connected to the receiver means operable to draw air, liquid, and particulate materials from the jet and work piece through said passage and discharge the liquid and particulate materials to a selected location.

33. The apparatus of claim 32 wherein: the means with a passage of the receiver means includes a tubular body having an inside wall, sleeve means located within said body adjacent said inside wall, said sleeve means providing said passage accommodating the air, liquid and particulate materials.

34. The apparatus of claim 33 including: rod means located within said passage spaced from and surrounded by the sleeve means.

35. The apparatus of claim 32 wherein: the receiver means has a tubular body with an upper end, lower end, and an inside wall extended between the upper and lower ends, sleeve means located adjacent said inside wall providing the passage for air, liquid, and particulate materials through the tubular body, cap means mounted on the upper end of the body, said cap means having an inlet opening open to said passage to allow air, liquid, and particulate materials to flow into said passage, base means having an outlet passage open to the passage of the sleeve means secured to the lower end of the tubular body, means mounting the base means for rotation about a longitudinal axis of the passage, and said drive means cooperating with the base to rotate the tubular body, sleeve means, and base means about the said longitudinal axis.

36. The apparatus of claim 35 including: generally upright rod means located in said passage below said cap means whereby air, liquid, and particulate materials flowing through said open inlet end impinge on said rod means and sleeve means as they move through said passage.

37. The apparatus of claim 32 wherein: said sleeve means comprises a plurality of cylindrical tubular members positioned end-to-end within said tubular body.

38. The apparatus of claim 32 wherein: the drive means to rotate the tubular body includes a motor and drive means connecting the motor to the tubular body whereby on operation of the motor the tubular body is rotated about the longitudinal axis thereof.

39. A method of collecting water, grit, and particulate materials emanating from an abrasive waterjet cutting a work piece with a receiver having a passage and an inlet opening and outlet opening open to the passage comprising: locating the inlet opening of the receiver adjacent the work piece and abrasive waterjet to allow water, grit, and work piece particulate materials to flow through the inlet opening into the passage of the receiver, said water, grit, and work piece particulate materials flowing through said passage and exiting therefrom through said outlet opening to a selected location, and rotating the receiver about an axis generally along the direction of flow of water, grit, and work piece particulate materials through the passage during flow of water, grit, and work piece particulate materials through said inlet opening, passage, and outlet opening.

40. The method of claim 39 including: applying a vacuum force to said outlet opening to draw air, water, grit, and work piece particulate materials through said passage during rotation of the receiver.

41. The method of claim 39 including: moving the abrasive waterjet along a path to cut the work piece in a desired direction, and moving the receiver concurrently with movement of the abrasive waterjet to continuously collect water, grit, and work piece particulate materials with said receiver, said water, grit, work piece particulate materials continuously flowing through said passage of the receiver during movement and rotation thereof.

42. The method of claim 41 including: applying a vacuum force to said outlet opening to draw air, water, grit, and work piece particualte materials through said passage during movement and rotation of the receiver.

* * * * *